US007048537B2

(12) United States Patent
Jaeschke et al.

(10) Patent No.: US 7,048,537 B2
(45) Date of Patent: May 23, 2006

(54) APPARATUS AND METHOD FOR CONTROLLING A VARIABLE FUEL FIRED APPLIANCE

(75) Inventors: Horst E. Jaeschke, Imperial, MO (US); Andrew Juengst, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/963,381

(22) Filed: Oct. 12, 2004

(65) Prior Publication Data

US 2006/0078837 A1 Apr. 13, 2006

(51) Int. Cl.
*F23N 5/00* (2006.01)

(52) U.S. Cl. ..... 431/28; 431/14; 431/66; 431/71; 219/497; 236/11; 700/274; 327/143

(58) Field of Classification Search ..... 236/10, 236/11, 15; 165/247, 279, 281; 700/2–4, 700/274, 20, 21, 299–301; 219/490, 506, 219/492–497; 431/13–16, 28, 58, 66, 89, 431/69–72; 327/141–143
See application file for complete search history.

(56) References Cited

U.S. PATENT DOCUMENTS 4,329,138 A * 5/1982 Riordan ..... 431/90
4,862,014 A * 8/1989 Myers et al. ..... 327/110
4,872,828 A * 10/1989 Mierzwinski et al. ..... 431/16
4,996,849 A * 3/1991 Burst et al. ..... 62/133
5,347,981 A * 9/1994 Southern et al. ..... 126/116 A
5,408,573 A * 4/1995 Jamieson et al. ..... 388/815
5,567,144 A * 10/1996 McCoy ..... 431/79
5,806,440 A * 9/1998 Rowlette et al. ..... 110/162
6,118,254 A * 9/2000 Faulk ..... 320/141
6,164,554 A * 12/2000 Pfister et al. ..... 237/12.3 C
6,464,000 B1 * 10/2002 Kloster ..... 165/247
6,521,869 B1 * 2/2003 Donnelly et al. ..... 219/263
6,801,157 B1 * 10/2004 Haynes ..... 342/124
2004/0228051 A1 * 11/2004 Dragoi et al. ..... 361/23
2005/0275446 A1 * 12/2005 Hairston ..... 327/336

FOREIGN PATENT DOCUMENTS

JP 63083519 A * 4/1988
JP 06147477 A * 5/1994

* cited by examiner

*Primary Examiner*—Crystal J Barnes
(74) *Attorney, Agent, or Firm*—Harness Dickey & Pierce PLC

(57) ABSTRACT

An apparatus is provided for controlling a fuel fired heating appliance, the apparatus comprising a first processor for controlling the ignition operation of the furnace and a second processor for controlling the operation of a variable speed blower motor, wherein the first processor sends communication signals to the second processor requesting a desired speed of the blower motor to provide air flow for combustion. The second processor responsively sends a signal to the first processor indicating the receipt of the requested speed for the blower motor. The apparatus further comprises at least one pressure switch, where the first processor senses an opening of the pressure switch and responds by successively sending incrementally higher speed request signals to the second processor until the first processor detects the closing of the at least one pressure switch.

8 Claims, 1 Drawing Sheet

APPARATUS AND METHOD FOR CONTROLLING A VARIABLE FUEL FIRED APPLIANCE

BACKGROUND OF THE INVENTION

The present invention is generally related to fuel-fired heating appliances, and more specifically to the control of a variable speed blower motor in a variable heating fuel-fired appliance.

Many fuel-fired appliances that provide variable heating rates utilize a variable speed motor to drive a blower fan for establishing air flow for combustion. Manufacturers of such heating appliances typically utilized an ignition control module to control the ignition operation of the appliance, and a separate motor processor module to control the variable speed blower motor. These prior art systems relied on the ignition control module to send a high or low speed signal, or alternatively a pulse-width modulated signal to the motor processor, which accordingly had to be configured to interpret the signal and establish the desired speed. The ignition controls of these prior art systems typically had no feedback from the motor processor, and relied on a pressure switch to determine if the desired blower flow rate had been established. If the blower speed was not sufficient to close the pressure switch, the ignition control could only request an incremental increase in speed without any feedback from the motor processor. HVAC systems accordingly relied on two separate controllers for system operation, in which an ignition processor could not verify whether the motor processor had received a speed request signal or whether the motor controller was even functioning.

SUMMARY OF THE INVENTION

The present invention relates to an apparatus for controlling a fuel fired heating appliance, the apparatus comprising a first processor for controlling the ignition operation of the furnace and a second processor for controlling the operation of the blower motor, wherein the first processor sends communication signals to the second processor which responsively establishes the desired speed of the blower having a variable speed blower motor to provide air flow for combustion. After the first processor sends a communication signal to establish a blower speed, the second processor sends a communication signal to the first processor indicating a receipt of the requested speed of operation. The first processor of the apparatus is also capable of detecting the closing of at least one pressure switch, and responsively signals the second processor to increase the speed of the blower motor until the first processor detects the closing of the at least one pressure switch. The closure of a pressure switch verifies the blower motor has established a desired air flow for combustion, and subsequently switches power to an igniter to establish burner operation.

In accordance with one aspect of the present invention, the apparatus can provide for two-way communication between the first and second processors, in which the first ignition processor may request information from the second motor processor pertaining to the voltage level between line and neutral. This voltage value may be evaluated by the first processor prior to supplying power to the igniter, such that a desired power level is provided that will allow the igniter to ignite gas without being unnecessarily overheated. In some embodiments, the apparatus therefore prolongs the life of the igniter and the operation of the appliance.

In another aspect of the present invention, the apparatus can provide for verification of communication from the first ignition processor to the second motor processor. In the event that the second motor processor is not responding to the first processor, the first ignition processor can communicate a reset signal to reset the second motor processor and reestablish communication with the second motor processor.

In yet another aspect of the present invention, the apparatus can provide for communication of diagnostic information between a first ignition processor and a second motor processor, and also for communication of diagnostics. In some embodiments, the apparatus further provides a means of communication via a single output to a first device or a second device, by switching from a first mode of communication to a first diagnostic reporting device, to a second mode of communication to a second motor processor device. In some embodiments, the second motor processor may communicate diagnostic information to the first ignition processor, which may then communicate to a multi-color flashing LED to provide an optical transmission of diagnostic information. This method of communication provides a simple, reliable means of controlling operation of the motor processor as well as a means of providing diagnostic information.

DETAILED DESCRIPTION OF THE INVENTION

Figure 1:
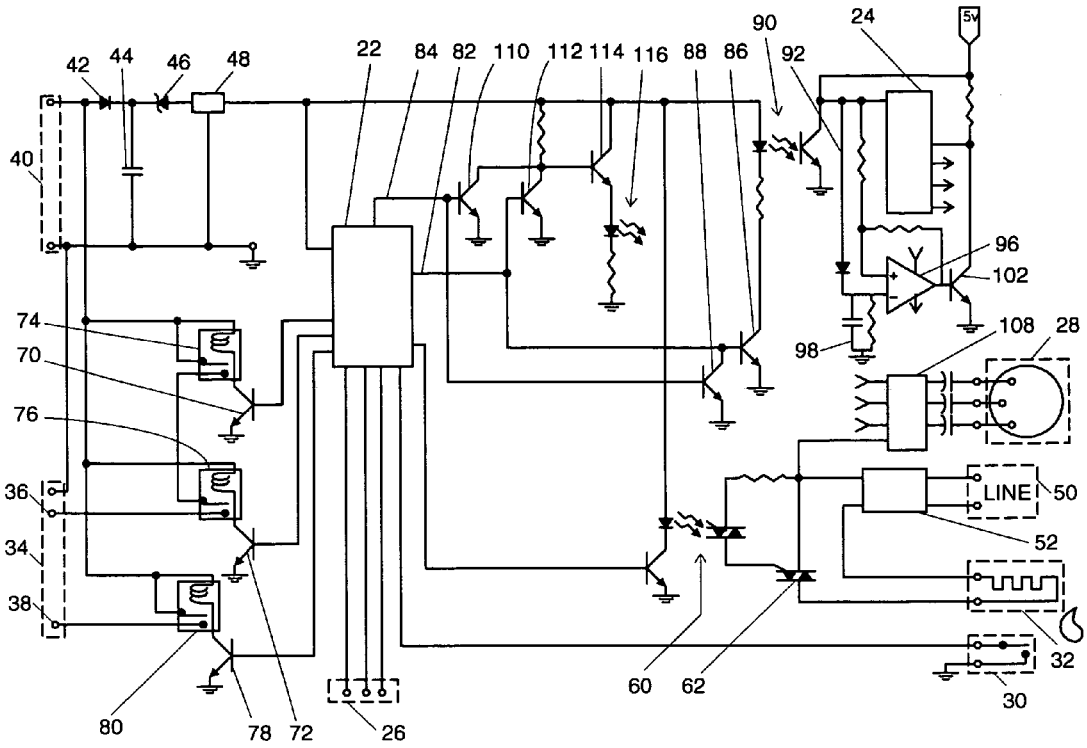
FIG. 1 is schematic diagram of one embodiment of an apparatus according to the principles of the present invention.

One embodiment of an apparatus for controlling a fuel-fired appliance according to the principles of the present invention is illustrated in FIG. 1, and comprises a first ignition processor 22 and a second motor processor 24. The apparatus comprises connection means for various appliance components including a thermostat 26, a blower motor 28, a pressure switch 30, an igniter 32 and a gas valve 34. The first ignition processor 22 is connected to a half-wave regulated 5 volt power supply, which is supplied by a 24 vac power source 40. The 5 v power supply comprises a diode 42 and a zener diode 46 in series with a voltage regulator 48, and also a capacitor 44. The second processor for the blower motor is connected to a separate power supply (not shown) that is supplied by a 120 vac power source 50. The circuitry for the first processor and second processor are electrically isolated from each other within the apparatus. The apparatus includes connection means for connecting the apparatus to a three-phase blower motor 28, and a pressure switch 30. When receiving a request signal for heating from the thermostat 26, the first processor 22 for controlling the ignition operation may signal the second processor 24 to request the blower motor 28 to ramp up to a desired speed. When the desired level of air flow is established by the blower motor 28, the pressure switch 30 will close. The first ignition processor 22 monitors the closure of the pressure switch 30 to verify sufficient air flow is present for combustion, before switching power to an igniter 32 for igniting the supply of fuel. When the igniter 32 has been sufficiently warmed up, the first ignition processor 22 outputs a signal to activate the gas valve 34 to initiate the supply of gas to be ignited.

The ignition processor 22 of the present invention is preferably a ST72C334 microprocessor manufactured by ST Microelectronics. The ignition processor controls the start of the blower motor 28 by first establishing communication with the motor processor 24. The ignition processor 22 provides a high enable signal from a communication enable pin at 82 to gate a transistor 86 to a conductive state, which switches 5 volts to a light-emitting diode of an opto-isolator 90. The ignition processor 22 generates a 9600 baud rate serial bit stream signal at 84 from a data port, such as a Universal Asynchronous Serial Port (UART). The serial transmission signal gates transistor 88 on and off, which intermittently shunts the high enable signal away from transistor 86, to allow transistor 86 to switch the opto-isolator transistor 90 on and off. The serial bit stream signal output from the opto-transistor 90 is input to the second motor processor 24, which receives the signal requesting the blower motor 28 be ramped up to a desired speed to establish air flow for combustion.

The second processor 24 of the present invention is preferably a Digital Signal Processor ADMCF328 manufactured by Analog Devices. The second processor 24 receives the signal from the first processor, and subsequently measures the line-to-neutral voltage and generates three sine wave forms 106 from a 170 VDC source using a power module 108. The power module 108 in the present invention is preferably a IRAMS10UP60 manufactured by International Rectifier. The three rectified sine wave outputs are connected to the blower motor 28, and are varied in frequency and voltage amplitude to control the speed of the blower motor. The use of rectified variable frequency drive circuits for controlling motor speed is well known in the art, and will not be covered in detail.

As the blower motor 28 ramps up to the desired speed predetermined by the first ignition processor 22, the ignition processor 22 monitors the closure of a pressure switch 30. If the pressure switch 30 does not close, the ignition processor 22 sends a request signal for an incrementally higher speed to the motor processor 22. Upon closure of the pressure switch 30, the first ignition processor 22 stores the last requested speed value at which the pressure switch closed. The ignition processor 22 may then request this speed in subsequent cycles for establishing a desired blower motor speed. The second motor processor 24 responds by outputting a serial bit stream signal to the first ignition processor 22, signaling the receipt of the requested speed signal, and responsively changes the speed of the blower motor. In the event the Digital Signal Processor, or second motor processor 24, locks up and does not respond to the first ignition processor 22, the first ignition processor transmits a signal to the second motor processor at a reduced baud rate to prompt a reset of the second motor processor 24. In particular, a reset circuit monitors the transmission signal output from the opto-transistor 90 at node 92. The reduced baud rate transmission causes the UART port to be held low for a long enough period to exceed the time constant of the resistor-capacitor circuit 98, so as to reduce the voltage input to the inverting pin of an op-amp 96. A non-linear op-amp circuit configured as a comparator is used to determine when the transmission signal voltage to the inverting pin drops below a reference voltage to the non-inverting pin, and responsively provides an output voltage that gates a transistor 102 to shunt a 5v signal away from the second motor processor 24 for resetting the processor.

The first ignition processor 22 may also request the second motor processor 24 to transmit the value of the voltage between line and neutral. This value may then be used by the first ignition processor 22 to determine an on-off sequence for switching line voltage to the igniter that will power or heat up the igniter to a level sufficient to ignite gas, without overheating the igniter. Specifically, the first ignition processor determines a switching rate based on the line voltage value received from the second motor processor, and drives a transistor 58 to gate an opto-triac switch 60 on and off. The opto-triac 60 drives a triac 62 for switching line voltage 50 through a filter 52 to the igniter 32. With the closed pressure switch 30 indicating sufficient air flow and the igniter 32 heated up, the ignition processor 22 drives transistors 70 and 72 for switching a pair of redundant relays 74 and 76 to a closed position to actuate the main valve 36 of the gas valve 34. This initiates the supply of gas to the igniter 32, to establish flame for a first heating rate. When receiving a request signal for a higher stage of heating from thermostat 26, the first ignition processor 22 transmits a signal to the second motor processor 24 requesting an increase in blower motor speed to establish a higher air flow for combustion. The higher blower speed may close a second pressure switch (not shown) to indicate sufficient air flow is present for the higher combustion rate. The first ignition processor 22 then drives a transistor 78 for switching a relay 80 to activate the second stage valve 38 of the gas valve 34.

The first ignition processor 22 is capable of transmitting a serial data stream at a first baud rate to the second motor processor through a single data port, which is also used to transmit data at a second baud rate to a flashing LED. When the ignition processor 22 provides a high enable signal, the transmitted data intended for the second motor processor is not seen by the flashing LED. When the enable pin is high at 82, transistor 112 shunts the transmission signal 84 away from the gate of transistor 114 to prevent switching of the LED 116. Likewise, when the enable pin is low at 82, the transistor 86 is non-conductive to prevent communication to the second motor processor 24, while a second 4800 baud rate signal at 84 is used to switch transistor 110 on and off to intermittently shunt 5v away from transistor 114, for switching 5 volts on and off to the flashing LED 116. in the event that communication with the second motor processor is lost or cannot be restored, or in the event that the blower motor has been diagnosed by the second motor processor to be inoperable, the first ignition processor can provide a diagnostic signal to the Light port LED. This provides for optical transmission of diagnostic information related to the blower motor or fuel fired appliance to a service technician. The first ignition processor 22 may also communicate diagnostic information relating to a malfunctioning pressure switch, ignition error, flame roll-out, or other error.

It should be noted that the method of switching the enable signal for providing communication via a signal data port to a first or second device may be used for devices other than a flashing LED. A third microprocessor could also receive communication from the first ignition processor. Likewise, if two way communication is required with the third microprocessor, the receive port could be multiplexed in a similar manner to allow both the second motor processor and the alternative third microprocessor to communicate via a single receive port on the first ignition processor 22.

Additional design considerations, readily apparent to one of ordinary skill in the art, such as modification of the apparatus to provide an output signal for a modulating gas valve for varying the supply of fuel to enable an infinitely variable heating appliance, may also provide improved appliance operation. It should be apparent to those skilled in the art that various modifications such as the above may be made without departing from the spirit and scope of the invention. More particularly, the apparatus may be adapted to any of a variety of different gas fired appliances including gas clothes dryers and furnaces. Accordingly, it is not intended that the invention be limited by the particular form illustrated and described above, but by the appended claims.

What is claimed is:

1. An apparatus for controlling a fuel fired heating appliance having a variable speed blower motor and at least one pressure switch, the apparatus comprising:

a first processor for controlling the operation of the heating appliance and for monitoring the opening of at least one pressure switch, the first processor being configured to send a speed request signal when the pressure switch is open for establishing a blower motor speed, and successive speed request signals requesting an incrementally higher blower speed until the at least one pressure switch closes, wherein if the pressure switch does not close within a predetermined time period from the point the pressure switch is first checked after the blower motor has ramped up to speed, the first processor shuts off the fuel fired appliance;

a second processor for controlling the operation of the blower motor, the second processor being configured to receive a speed request signal and responsively establish the requested speed for the blower motor, wherein upon request from the first processor the second processor sends a communication signal to the first processor indicating receipt of the speed request signal; and a reset signal monitoring circuit for monitoring the communication signals from the first processor and responsively resetting the second processor when detecting a reset request signal from the first processor, wherein the reset signal monitoring circuit comprises at least one transistor and a non-linear op-amp for comparing the first processor signal voltage at the inverting pin to a reference voltage at the non-inverting pin, and responsively providing an output voltage that gates the transistor to switch voltage to the second processor to reset the second processor.

2. The apparatus of claim 1, wherein the first processor and second processor are microprocessors.

3. The apparatus of claim 2, further comprising an LED that receives a signal from the first processor to provide a means of communicating operating status.

4. The apparatus of claim 3, wherein the LED communicates diagnostic information related to the blower motor.

5. An apparatus for controlling a fuel fired heating appliance, the apparatus comprising:

a first microprocessor for controlling the operation of the fuel fired appliance, the first microprocessor being capable of transmitting via a single output pin signals in a first signal transmission mode to a first device in the apparatus, and in a second signal transmission mode to a second device in the apparatus, the first microprocessor providing a high or low enable signal for controllably switching the output pin signal to either the first device or the second device;

wherein the high enable signal switches a first transistor on to short the transmission signal away from the first device, and also switches a second transistor on to enable transmission to the second device.

6. The apparatus of claim 5, wherein the low enable signal switches the first transistor off to allow transmission of the signal to the first device, and also switches the second transistor off to prevent transmission to the second device.

7. An apparatus for controlling a fuel fired heating appliance, the apparatus comprising:

a first microprocessor for controlling the operation of the fuel fired appliance, the first microprocessor being capable of transmitting via a single output pin signals in a first signal transmission mode to a first device in the apparatus, and signals in a second signal transmission mode for sending speed request signals to a second microprocessor, the first microprocessor controllably switching of the output pin signal to either the first device or the second microprocessor; and a second microprocessor controlling the generation of three alternating waveform signals that are varied in frequency and voltage amplitude for establishing a desired speed of a blower motor, wherein the second microprocessor receives a speed request signal from the first microprocessor and responsively establishes the desired requested speed for the blower motor and sends a communication signal to the first microprocessor indicating receipt of the speed request signal, where upon request from the first microprocessor the second microprocessor sends a communication signal to the first microprocessor indicating the value of the voltage between line and neutral; and an igniter for igniting gas, wherein the first microprocessor controls the switching of line voltage to the igniter based on the value of the voltage between line and neutral to precisely control power supplied to the igniter.

8. An apparatus for controlling a fuel fired heating appliance, the apparatus comprising:

a first microprocessor for controlling the operation of the fuel fired appliance, the first microprocessor being capable of transmitting via a single output pin signals in a first signal transmission mode to a first device in the apparatus, and signals in a second signal transmission mode for sending speed request signals to a second microprocessor, the first microprocessor controllably switching the output pin signal to either the first device or the second microprocessor;

a second microprocessor for controlling the operation of a blower motor, wherein the second microprocessor receives a speed request signal from the first microprocessor and responsively establishes the desired requested speed for the blower motor and sends a communication signal to the first microprocessor indicating receipt of the speed request signal; and a reset signal monitoring circuit for monitoring the communication signals from the first microprocessor, wherein the first microprocessor transmits a reset signal when the second microprocessor does not respond to a signal from the first microprocessor, and the reset signal monitoring circuit resets the second microprocessor in response to detecting the reset signal from the first microprocessor, wherein the reset signal monitoring circuit comprises at least one transistor and a non-linear op-amp for comparing the first microprocessor signal voltage at the op-amp inverting pin to a reference voltage at the op-amp non-inverting pin, and responsively providing an output voltage that gates the transistor to switch voltage to the second microprocessor to reset the second microprocessor.

* * * * *